US005411469A

United States Patent [19]

Wang

[11] Patent Number: 5,411,469

[45] Date of Patent: May 2, 1995

[54] SUSPENSION TYPE FOOT MASSAGER

[76] Inventor: Hong-Shang Wang, No. 12, Dah Hwu, Hwu Pei Lee, Dah Lin Chen, Chia I Hsien, Taiwan, Prov. of China

[21] Appl. No.: 215,255

[22] Filed: Mar. 21, 1994

[51] Int. Cl.[6] ..... A61H 7/00

[52] U.S. Cl. ..... 601/92; 601/90; 601/98

[58] Field of Search ..... 601/84–104, 601/49, 51, 53, 54; 297/423.42, 423.43, 271, 273; 5/108, 109, 103; 482/79; 74/40, 42, 53, 54

[56] References Cited

U.S. PATENT DOCUMENTS

| | | | |
|---|---|---|---|
| D. 340,116 | 10/1993 | Ohashi | D24/213 |
| D. 340,529 | 10/1993 | Ohashi | D24/215 |
| D. 351,024 | 9/1994 | Chou | D24/215 |
| 976,993 | 11/1910 | Ellis | 601/97 |
| 2,433,548 | 8/1945 | Ecks | 601/90 |
| 2,534,438 | 7/1947 | Gosselin | 5/109 |
| 2,644,958 | 5/1951 | Davis | 601/90 |
| 3,022,520 | 5/1959 | Finger | 601/98 |
| 4,277,857 | 7/1981 | Svehaug | 601/90 |
| 5,107,822 | 4/1992 | Ohashi | 601/93 |
| 5,328,443 | 7/1994 | Lee | 601/93 |

*Primary Examiner*—Robert A. Hafer
*Assistant Examiner*—David J. Kenealy
*Attorney, Agent, or Firm*—Bacon & Thomas

[57] ABSTRACT

A foot massager includes a casing, an L-shaped mount having a horizontal wall fastened to the bottom of the casing and a vertical wall upstanding from the bottom of the casing, a motor horizontally mounted on the L-shaped mount, a foot rest suspended above the casing, an eccentric wheel driven by the motor through the mandrel of a speed reducing gear to oscillate the foot rest through an oscillating element via two links vertically disposed in parallel, each link having a top end pivoted to the vertical wall of the L-shaped mount and a bottom end pivoted to the oscillating element. The oscillating element has a top end connected to the foot rest, an elongated guide groove vertically disposed in the middle between the links and the eccentric wheel has a transmission shaft perpendicularly inserted into the elongated guide groove and turned to move back and forth along the elongated guide groove, causing the foot rest to oscillate.

7 Claims, 6 Drawing Sheets

SUSPENSION TYPE FOOT MASSAGER

BACKGROUND OF THE INVENTION

1. Field of the Invention

The present invention relates to a foot massager, and more particularly to a suspension type foot massager.

2. Description of the Prior Art

Various foot massaging and exercising apparatus have been disclosed, and have appeared on the market. Among these apparatus, there is known a suspension type foot massager which comprises a motor, a speed reducing gear coupled to the output shaft of the motor, an eccentric wheel driven by the output shaft of the speed reducing gear, an internal wheel mounted on the shaft on the eccentric wheel and received in an elongated hole on a slide block, and a foot rest supported on the slide block. When the motor is turned on, the slide block is reciprocated along two axles causing the foot rest to be moved back and forth alternatively, and therefore the legs which rest on the foot rest are vibrated. Because this structure of foot massager can only reciprocate the foot rest horizontally, it provides less effect in massaging the muscles of the legs. Another drawback of this structure of foot massager is that noises will be produced when the slide block is reciprocated along the axles. Still another drawback of this structure of foot massager is that the slide block may be stuck easily after long usage.

SUMMARY OF THE INVENTION

The present invention has been accomplished to provide a suspension type foot massager which eliminates the aforesaid drawbacks.

According to the preferred embodiment of the present invention, two links are vertically disposed in parallel, having each a top end pivoted to the vertical wall of an L-shaped mount inside the casing of the foot massager and a bottom end pivoted to an oscillating element which is coupled to a transmission shaft of the eccentric wheel of the motor drive of the foot massager by a vertical guide groove thereof and connected to the foot rest of the foot massager at the bottom. Therefore, when the motor is started, the oscillating element is moved to oscillate the foot rest in vibrating the user's legs.

DETAILED DESCRIPTION OF THE PREFERRED EMBODIMENT

Figure 1:
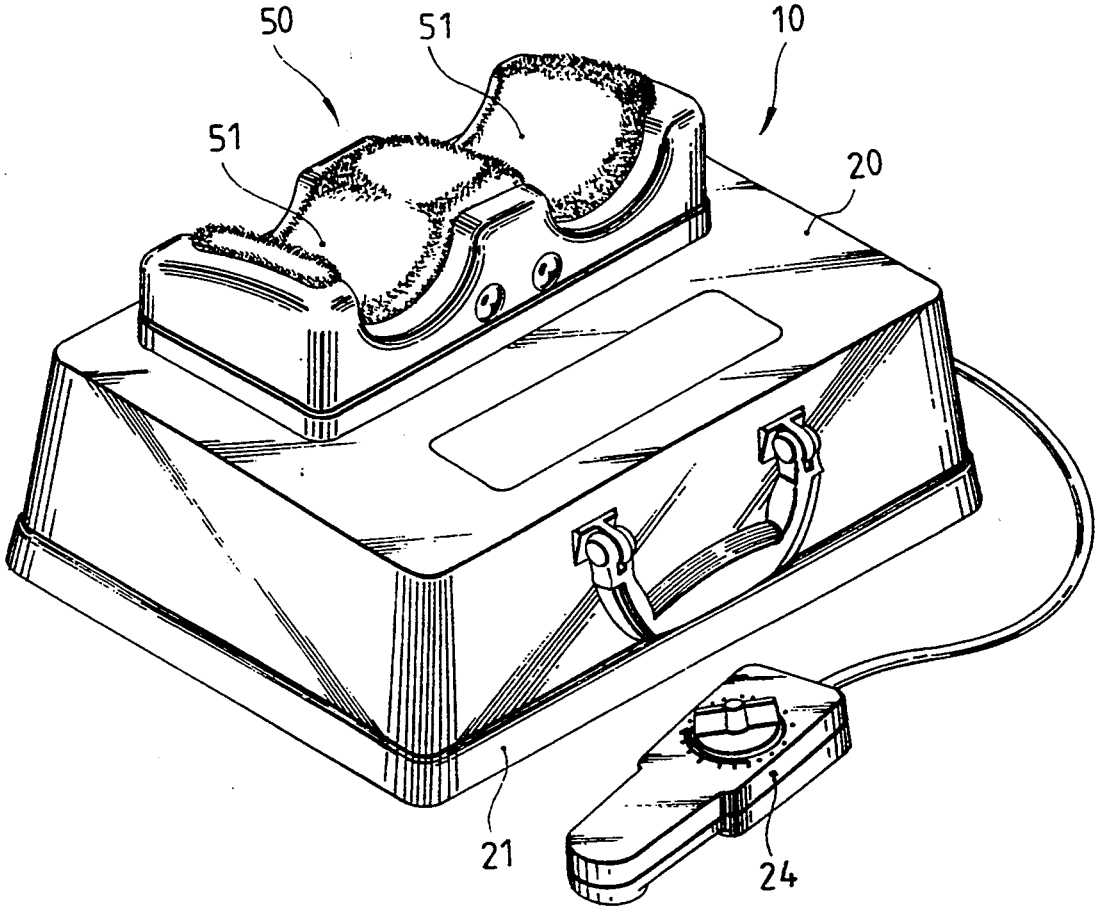
FIG. 1 is a perspective view of a suspension type foot massager according to the preferred embodiment of the present invention.
Figure 2:
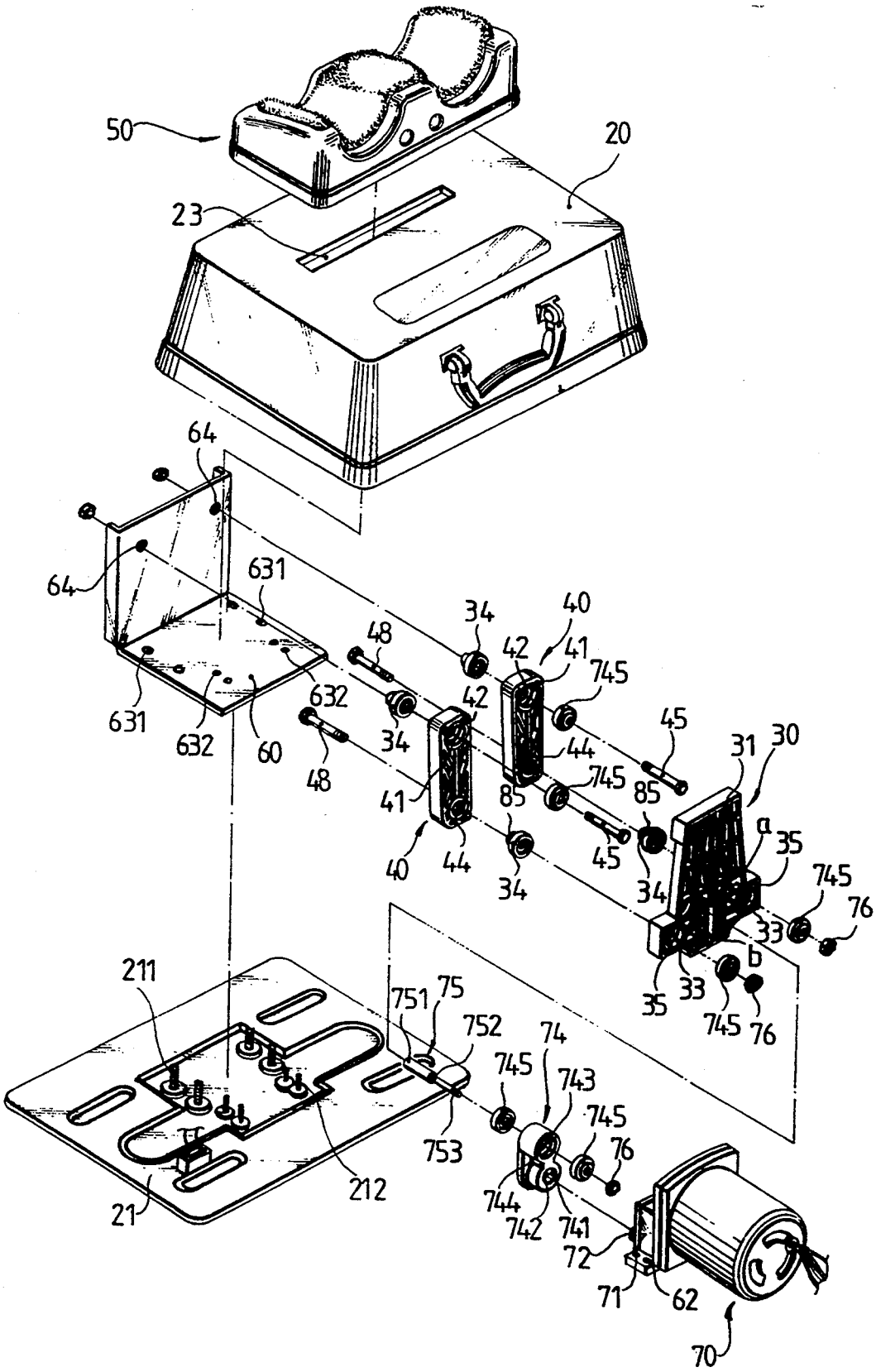
FIG. 2 is an exploded view of the foot massager shown in FIG. 1.
Figure 3:
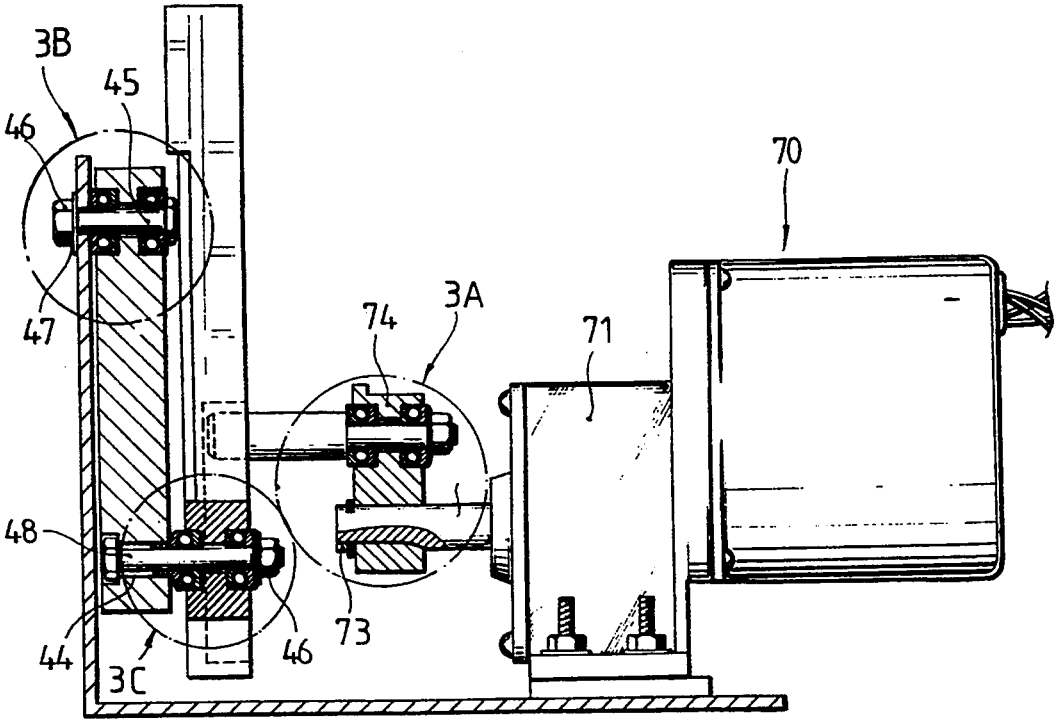
FIG. 3 is a partial cross section view showing the internal structure of the foot massager shown in FIG. 1.

Referring to FIGS. 1, 2, and 3, a suspension type foot massager in accordance with the preferred embodiment of the present invention is generally comprised of a casing 20, an oscillating element 30, two links 40, an foot rest 50, a L-shaped mount 60, an eccentric wheel 74, and a motor 70.

The casing 20 is made of rectangular shape having a bottom opening (not shown) covered by a bottom plate 21 and an elongated slot 23 at the top. An external timer 24 is connected to the casing 20 for controlling the operation time of the motor 70.

The L-shaped mount 60 comprises a plurality of through holes 631;632 on the horizontal wall thereof and is respectively fastened to the bottom plate 21 at the top (within the casing 20) by screw bolts 211;212. The screw bolts 212 are also fastened to respective through holes 62 on the casing of the motor 70, and therefore the motor 70 is fixed to the horizontal wall of the mount 60 supported above the bottom plate 21. There is provided a speed reducing gear 71 having one end coupled to the motor shaft (not shown) of the motor 70 and an opposite end coupled with a mandrel 72. The mandrel 72 has a longitudinal key way 73.

Figure 3A:
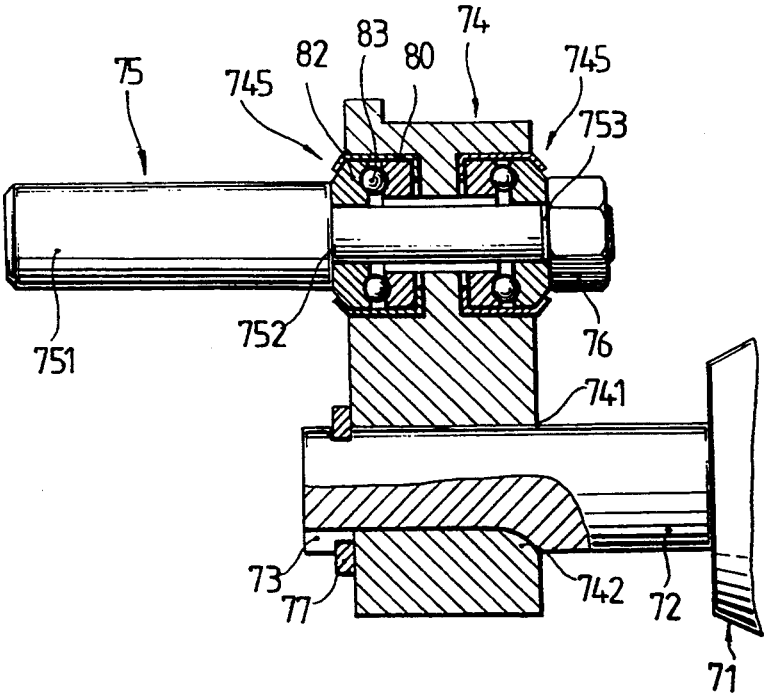
FIG. 3A is an enlarged view taken on part 3A of FIG. 3.

Referring to FIG. 3A and FIG. 2 again, the eccentric wheel 74 comprises a first through hole 741, which receives the mandrel 72, which when inserted through the first through hole 741 is fastened with a C-shaped retainer ring 77 and therefore it does not disconnect from the eccentric wheel 74. A key 742 is disposed inside the first through hole 741 and engaged into the key way 73, a second through hole 744 is disposed in parallel with the first through hole 741, which receives a transmission shaft 75. Two annular grooves 743 extend around two opposite ends of the second through hole 744, and two first bearings 745 are respectively mounted in the annular grooves 743 to support the transmission shaft 75 in the second through hole 744. The transmission shaft 75 has one portion 752 supported on a first bearing 745 and an end supported on the other first bearing 745, with the end terminating in an outer thread portion 753 which extends out of the second through hole 744 at one side and fastened with a nut 76. The opposite end, namely, the transmission end 751 of the transmission shaft 75 is extended out of the second through hole 744 at an opposite side.

Referring to FIG. 2 again, the link 40 is shaped like an elongated, flat plate having two opposite annular grooves 41 around two opposite ends of a through hole 42 thereof, a first bearing 745 and a second bearing 34 are respectively mounted on the annular grooves 41.

Figure 3B:
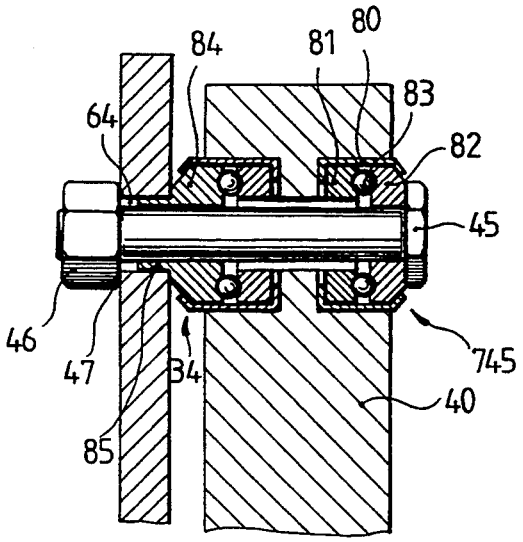
FIG. 3B is an enlarged view taken on part 3B of FIG. 3.

Referring to FIG. 3B and FIG. 2 again, the aforesaid first bearing 745 comprises an outer shell 80, an inner ball race 81 and an outer ball race 82 received within the outer shell 80, and a plurality of steel balls 83 retained between the inner and outer ball races 81;82. The inner diameter of the inner ball race 81 is relatively bigger than that of the outer ball race 82. The second bearing 34 is substantially similar to the first bearing 745, however the second bearing 34 has an outward flange 85 at an outer side thereof around the inner diameter of bearing 34.

Referring to FIG. 2 again, the outward flange 85 of the second bearing 34 on each link 40 is engaged into a respective locating hole 64 on the vertical wall of the L-shaped mount 60. A screw bolt 45 is inserted through the first and second bearings 745;34 on the link 40 and the respective locating hole 64, then a nut 46 is fastened to the outer thread 47 of the screw bolt 45 to secure the link 40 to the L-shaped mount 60.

Figure 3C:
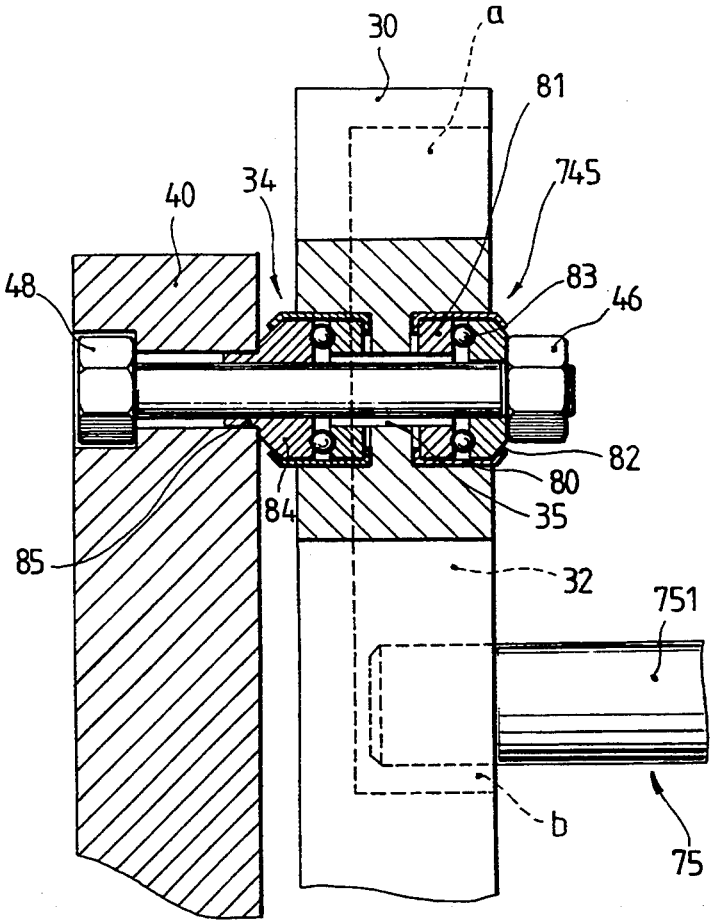
FIG. 3C is an enlarged view taken on part 3C of FIG. 3.

Referring to FIG. 3C and FIG. 2 again, the oscillating element 30 is made of flat shape comprising two screw holes 31 horizontally spaced near the top and disposed outside the casing 20 through the elongated slot 23 for mounting the foot rest 50. An elongated guide groove 32 is vertically disposed in the middle of element 30 and receives the transmission end 751 of the transmission shaft 75, with two through holes 35 disposed at two opposite sides of the elongated guide groove 32, two opposite annular grooves 33 disposed around the two opposite ends of each through hole 35, a first bearing 745 and a second bearing 34 respectively mounted on the two opposite annular grooves 33 at the two opposite ends of each through hole 35 and permitting the outward flange 85 of the second bearing 34 to engage into a hexagonal countersunk hole 44 on the bottom of either link 40. A respective hexagonal head screw bolt 48 is inserted through the hexagonal countersunk hole 44 on either link 40 and the first and second bearings 745;34 on the respective through hole 33 of the oscillating element 30 and then fastened with a respective nut 76. When fastened, the hexagonal head of each hexagonal head screw bolt 48 is respectively received within the hexagonal countersunk hole 44 on either link 40. Therefore, the oscillating element 30 is coupled to the two links 40.

Figure 4:
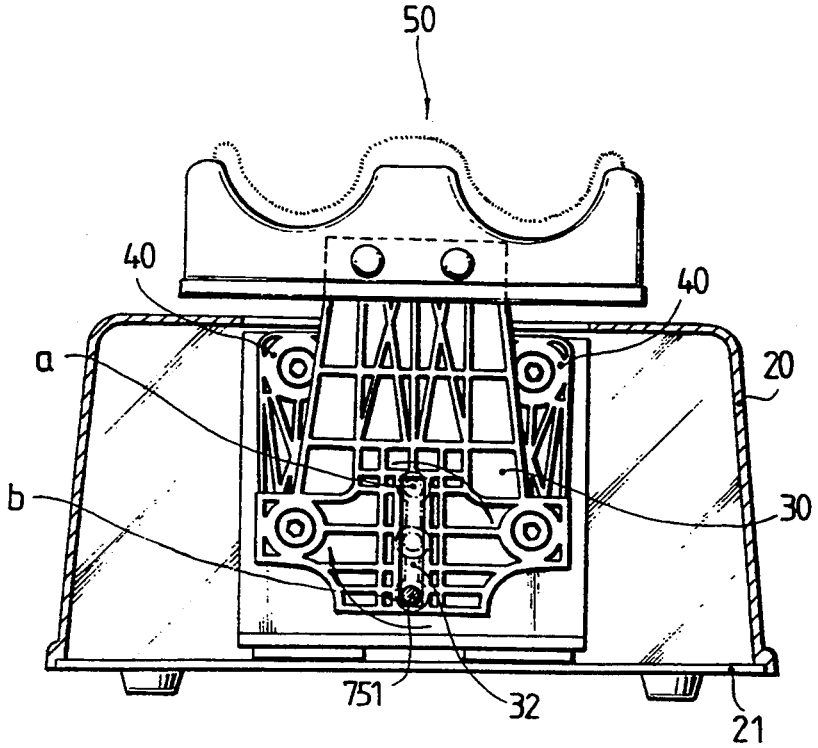
FIG. 4 is an elevational view of the foot massager shown in FIG. 1 before operation.
Figure 6:
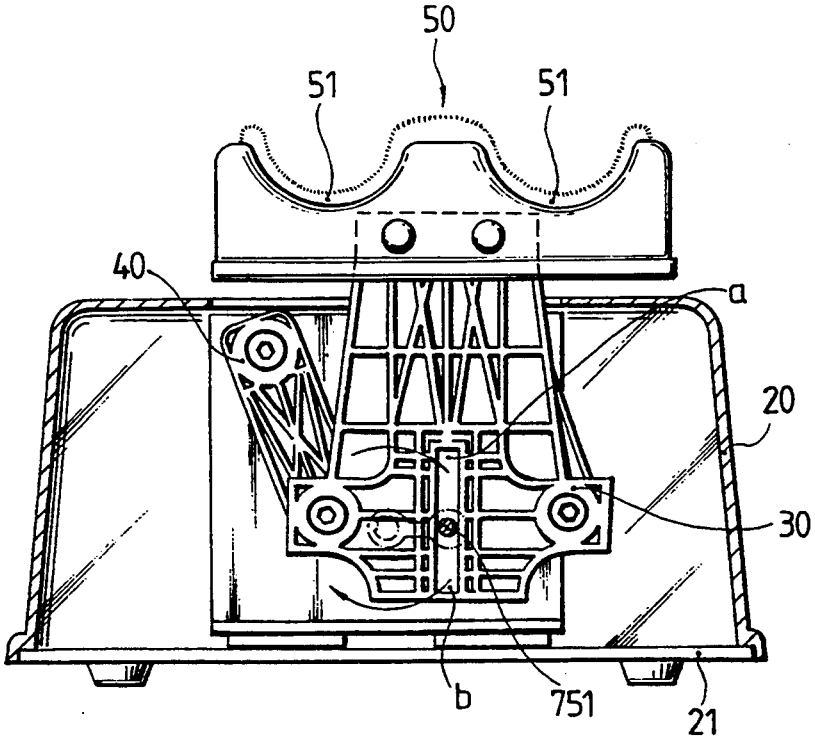
FIG. 6 is similar to FIG. 4 but showing the foot rest moved to the right.
Figure 5:
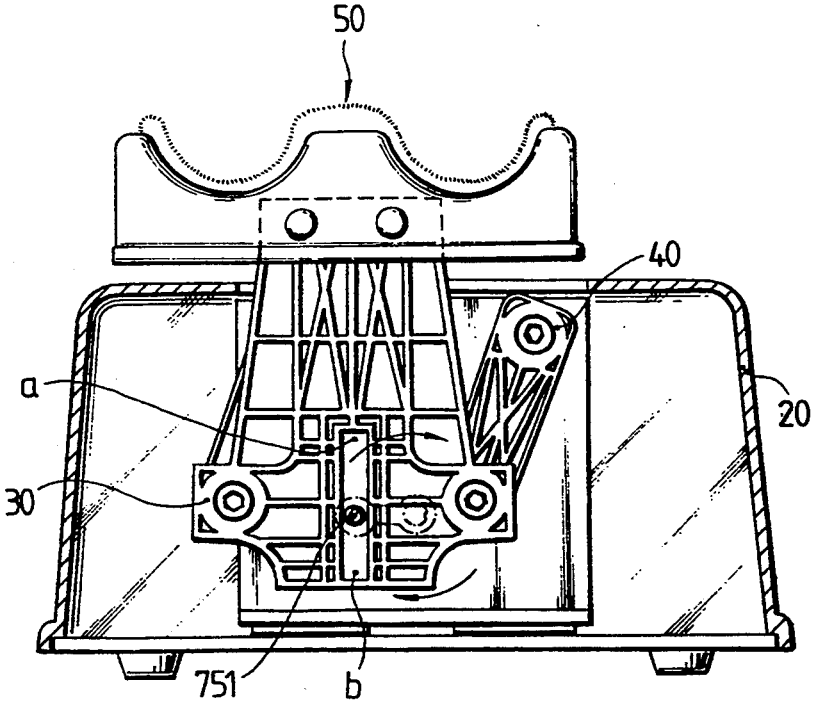
FIG. 5 is similar to FIG. 4 but showing the foot rest moved to the left.

Referring to FIGS. 4, 5, and 6, when the foot massager does no work, the transmission end 751 of the transmission shaft 75 is disposed at the bottom of the elongated guide groove 32 on the oscillating element 30 (at this stage, the lower dead point b of the oscillating element 30 is disposed at the bottom), and the links 40 are respectively disposed in vertical (see FIG. 4). When the motor 70 is started, the speed reducing gear 71 is driven to move the transmission shaft 75 through the mandrel 72 via the eccentric wheel 74. When the transmission end 751 of the transmission shaft 75 is turned clockwise, the oscillating element 30 is forced by the transmission shaft 75 to move the links 40 causing them to turn on the respective screw bolt 45, and therefore the oscillating element 30 is moved leftward by the links 40 (at this stage, the upper dead point a is disposed in the center of the elongated guide groove 32). Because the oscillating element 30 is coupled to the links 40, it is synchronously moved back and forth by the links 40 along the periphery of a circle. When the oscillating element 30 is moved rightward, the links 40 and the foot rest 50 are simultaneously moved upwards along the periphery of the circle. When the transmission end 751 of the transmission shaft 75 is disposed at the lower dead point b in the elongated guide groove 32, the foot rest 50 is disposed at the lowest position as shown in FIG. 4; when the transmission end 751 is moved to the midpoint during the leftward oscillating movement of the oscillating element 30, the foot rest 50 is lifted to the topmost position as shown in FIG. 5; when the transmission end 751 is moved to the upper dead point a, the foot rest 50 is moved to the lowest position as shown in the dotted line in FIG. 5; when the transmission end 751 is moved to the midpoint during the rightward oscillating movement of the oscillating element 30, the foot rest 50 is lifted to the topmost position again, as shown in FIG. 6; when the transmission end 751 is moved to the lower dead point b again, the foot rest 50 is moved to the lowest position again. During the operation of the foot massager, the aforesaid procedure is repeated again and again.

When in use, the user's legs are rested on the two recessed portions 51 on the foot rest 50. As the motor 70 is started, the legs will be oscillated back and forth along a U-shaped path.

What is claimed is:

1. A foot massager comprising:

a) a casing including a bottom portion;

b) an L-shaped mount including a horizontal wall secured to the bottom portion of the casing and an upstanding vertical wall;

c) a motor mounted on the L-shaped mount, the motor including a speed reducing gear and a mandrel rotated by the motor;

d) a foot rest disposed above the casing;

e) a transmission assembly drivingly connecting the foot rest with the mandrel for oscillating the foot rest along a substantially U-shaped path during operation of the motor, the transmission assembly including:

1. an eccentric wheel connected to the mandrel,
2. an oscillating member including an elongated guide groove and a top portion, the foot rest being mounted to the top portion,
3. a pair of links, each link including a top end pivotally secured to the vertical wall of the L-shaped mount and a bottom end pivotally secured to the oscillating member, and at a point closer to the horizontal wall than the top end pivot point
4. a transmission shaft including a first end connected to the eccentric wheel and a second end slidably engaged within the elongated guide groove of the oscillating member; and f) whereby during rotation of the mandrel by the motor, the second end of the transmission shaft is caused to slidably reciprocate along the elongated guide groove between an upper dead point and a lower dead point therein and cause the links to pivot about their top ends while maintained in a parallel disposition, thereby causing the oscillating member to oscillate the foot rest back and forth along a substantially U-shaped path.

2. The foot massager of claim 1 wherein said eccentric wheel comprises a first through hole for receiving said mandrel, which when inserted through said first through hole is retained in place by a C-shaped retainer ring around an annular groove thereof, a key disposed inside said first through hole and engaged into a key way on said mandrel, a second through hole disposed in parallel with said first through hole for receiving said transmission shaft, two first bearings respectively mounted within two opposite annular grooves around two opposite ends of said second through hole to support said transmission shaft in said second through hole, and the first end of said transmission shaft having a fixed end externally threaded and inserted through the first and second bearings and fastened with a nut.

3. The foot massager of claim 1 wherein each link is shaped like an elongated, flat plate having a first bearing and a second bearing mounted within two opposite annular grooves around a through hole at the top end thereof and the top end being pivotally connected to a respective locating hole on the vertical wall of said L-shaped mount and a screw bolt pivotally connecting the bottom end of the link to the oscillating element.

4. The foot massager of claim 1 wherein said oscillating element further comprises two screw holes horizontally spaced near a top thereof and respectively connected to a side of said foot rest by a plurality of screws, the elongated guide groove being vertically disposed in the middle of the oscillating element, two bottom through holes disposed at two opposite sides of said elongated guide groove, a first bearing and a second bearing respectively mounted on two opposite annular grooves at two opposite ends of each bottom through hole and pivotally connected to a countersunk hole on the bottom end of each link by the screw bolt.

5. The foot massager of claim 2 wherein each said first beating comprises an outer shell, an inner ball race and an outer ball race received within the outer shell and a plurality of steel balls retained between the inner and outer ball races, the inner diameter of the inner ball race being relatively bigger than that of the outer ball race.

6. The foot massager of claim 3 wherein each said first bearing comprises an outer shell, an inner ball race and an outer ball race received within the outer shell and a plurality of steel balls retained between the inner and outer ball races, the inner diameter of the inner ball race being relatively bigger than that of the outer ball race and said second bearing includes an outer race and an outward flange raised from the outer race thereof at an outer side and fitted into the respective locating hole on the vertical wall of said L-shaped mount.

7. The foot massager of claim 3 wherein each link comprises a hexagonal countersunk hole at the bottom end connected to said oscillating element by a respective hexagonal head screw bolt, the hexagonal head screw bolt having the hexagonal head received in said hexagonal countersunk hole and a screw bolt body inserted through a respective through hole on said oscillating element, a beating supporting the screw bolt body, and a nut retaining the screw bolt body in place.

* * * * *